US006844855B2

(12) United States Patent
Carson

(10) Patent No.: US 6,844,855 B2
(45) Date of Patent: Jan. 18, 2005

(54) AIRCRAFT PHASED ARRAY ANTENNA STRUCTURE INCLUDING ADJACENTLY SUPPORTED EQUIPMENT

(75) Inventor: Ronald Steven Carson, Renton, WA (US)

(73) Assignee: The Boeing Company, Chicago, IL (US)

( * ) Notice: Subject to any disclaimer, the term of this patent is extended or adjusted under 35 U.S.C. 154(b) by 42 days.

(21) Appl. No.: 10/057,286

(22) Filed: Jan. 25, 2002

(65) Prior Publication Data

US 2003/0142024 A1 Jul. 31, 2003

(51) Int. Cl.[7] ..... H01Q 1/28
(52) U.S. Cl. ..... 343/705; 343/708
(58) Field of Search ..... 343/705, 708, 343/700 MS; 455/275, 93, 98, 345; 342/32, 35, 41, 45; H01Q 1/28

(56) References Cited

U.S. PATENT DOCUMENTS

| | | | | |
|---|---|---|---|---|
| 4,771,294 | A | 9/1988 | Wasilousky | |
| 5,019,829 | A | 5/1991 | Heckman et al. | |
| 5,463,656 | A | 10/1995 | Polivka et al. | |
| 6,606,055 | B2 * | 8/2003 | Halsema et al. | 342/368 |

FOREIGN PATENT DOCUMENTS

| | | |
|---|---|---|
| EP | 1271694 | 1/2003 |

OTHER PUBLICATIONS

"K/Ka–brand Antenna for Broadband Aeronautical Mobile Application", A. Densmore, Jet Propulsion Laboratory, California Institute of Technology, Pasadena, CA, 1994, pp. 1032–1035.

PCT/US03/01713, "PCT International Search Report", Mailed Jun. 5, 2003.

* cited by examiner

*Primary Examiner*—Hoanganh Le
(74) *Attorney, Agent, or Firm*—Harness Dickey & Pierce P.L.C.

(57) ABSTRACT

An aircraft phased array antenna system has transmit and receive antenna structures externally mounted on the aircraft fuselage. Each antenna comprises a plurality of phased array elements and antenna power and support equipment. Aerodynamically shaping antenna structure to enclose an antenna element grid provides additional antenna structure volume, which is efficiently utilized by locating antenna support equipment within the antenna structure. To control signal attenuation a receive antenna internal converter converts receive frequency signals to L-band frequency signals for aircraft use, and a similar transmit antenna converter converts L-band frequency signals to transmit frequency signals, thus unconstraining antenna to internal aircraft equipment spacing. To reduce power loss and cabling weight, antenna operating power is first generated in the 28 to 270 volts DC range within the aircraft, and locally converted in each antenna to the 3 to 6 volt DC power to operate each antenna's phased array elements.

26 Claims, 4 Drawing Sheets

AIRCRAFT PHASED ARRAY ANTENNA STRUCTURE INCLUDING ADJACENTLY SUPPORTED EQUIPMENT

FIELD OF THE INVENTION

The present invention relates generally to aircraft antenna systems and more specifically to a phased array antenna system having both phased array antenna elements and antenna support equipment mounted within the antenna structure.

BACKGROUND OF THE INVENTION

Aircraft utilize antenna and associated antenna support equipment to transmit, receive and download data communication signals. Aircraft antenna(s) are typically surface mounted on the outer fuselage of the aircraft. Aerodynamic drag concerns require the antenna(s) be shaped to reduce drag on the aircraft. Associated equipment is normally located inside the aircraft on support structures developed for this purpose.

When new systems or technologies are developed or additional communication system equipment is required on an aircraft, additional space must normally be found inside the aircraft for the associated support equipment. On commercial aircraft in particular, space is often created for this equipment in the overhead compartments, and in particular, over the walkways (i.e., central or side aisle-ways) of the aircraft. The drawback of using this space is its constraint on overhead height in the aircraft walkways.

Another problem exists on current aircraft that employ phased array communication antennas. Most currently employed phased array antennas operate at low voltage, i.e., three to six volts direct current (DC). This low voltage requires a correspondingly high current to operate the antenna system. Drawbacks to carrying high current include increased cabling weight between the antennas and their power transformers, and power loss due to heat generation and subsequent transmission loss. In an exemplary application currents as high as about 90 amperes must be carried. A 90 ampere current rating requires a cable size of about four gauge, American Wire Gauge (AWG) be used. Even with this size wire, however, cable heat and power loss places a practical limit on the distance between the power supply and the antennas to about 3.1 to 4.6 meters (10 to 15 feet). This constrains the location of the antenna and/or the location of the aircraft mounted antenna support equipment.

The above problems are compounded for aircraft required to communicate via signals from satellite communication systems. These systems utilize radio frequency (RF) signals in the Ku-band frequency range, for example in the 12 to 14 gigahertz (GHz) range. RF signals on the transmit channel are normally about 14 GHz and above (up to about 44 GHz) and RF signals on the receive channel are normally about 12 GHz and above (up to about 20 GHz). In this frequency range attenuation of signal strength becomes a critical drawback as the antenna/antenna equipment and aircraft communication equipment are separated. As an exemplary loss in the RF frequency range, about every three feet of signal line length used between the antenna and down-converting equipment results in approximately 50% loss in signal strength. As a practical result, an exemplary limit now applied to control this attenuation provides that down-converters be separated by a distance of no greater than about 1.2 meters (four feet) from their respective antenna(s). This places a greater constraint on the location of both the antenna(s) and antenna support equipment than the above noted constraint due to power loss.

Further problems are created for aircraft when new communication systems, such as Connexion By Boeing$^{SM}$, require one or more new antennas be installed. In the exemplary Connexion By Boeing$^{SM}$ system, the antennas are an intermediary subsystem between the aircraft and the ground. To incorporate the Connexion By Boeing$^{SM}$ system onboard an aircraft, two phased array antennas are required, and the associated support equipment for the phased array antennas, if stored within the aircraft, occupies about six boxes. In an example case of a narrow body aircraft (i.e., an aircraft having a single aisle), providing space to locate and mount eight boxes requires using space over the aircraft aisle-way. The drawback to this as noted above is reduced height along the center aisle-way of the narrow body aircraft. Wide body aircraft (i.e., two or more aisles) are constrained by addition of six boxes, but not to the same degree as narrow body aircraft.

It is aerodynamically desirable to place an antenna at the top of the aircraft fuselage along a vertical plane perpendicularly intersecting the aircraft's longitudinal axis near the leading edge of the aircraft wings. This preferred antenna location, together with the above equipment and cable length constraints, further constrains the arrangement. In an alternate arrangement, sets of antennas are provided. Multiple arrangements are possible. Two exemplary arrangements are a first fore-aft arrangement comprising two antennas and a second side-by-side arrangement of preferably four antennas. With the side-by-side arrangement, two antennas are preferably located on each side of the aircraft, to improve the field of view toward the horizon (also called a "saddlebag" configuration). Both saddlebag and fore-aft arrangement antenna configurations improve the arrangement of support equipment by spreading out the equipment, but still constrain the overall arrangement if the support equipment is all located within the aircraft.

SUMMARY OF THE INVENTION

In addition to the advantages noted herein, the above goals are achieved and the above noted drawbacks and limitations for aircraft communication systems are overcome by the antenna system of the present invention.

In one aspect of the present invention, a phased array antenna system for a mobile platform is provided. The system comprises the following. A transmit antenna is disposed within a transmit antenna housing and a receive antenna is disposed within a receive antenna housing. The receive antenna operates to receive a receive antenna signal and converts the receive antenna signal to an aircraft communication frequency signal before outputting the receive antenna signal from the receive antenna housing. The transmit antenna operates to transmit a transmit antenna signal and converts the aircraft communication frequency signal into the transmit antenna signal within the transmit antenna housing.

In another aspect of the invention, a phased array antenna communication system for external mounting on a mobile platform is provided. The system comprises the following. A pair of antennas are provided. One of the antennas is a transmit antenna and one is a receive antenna. At least one antenna housing is provided for the transmit antenna and the receive antenna. Each antenna housing has either a transmit antenna equipment group or a receive antenna equipment group. The equipment group electrically communicates with an onboard aircraft communication signal. The onboard communication signal has an operating frequency ranging from an ultra-high frequency to an L-band frequency. An aircraft mounted converter converts an aircraft service voltage to an antenna power transfer voltage. Each antenna housing has a transfer converter to convert the transfer voltage to an antenna operating voltage for local use in the antenna.

In a further aspect of the invention, an aircraft phased array antenna communication system is provided having antennas and antenna servicing equipment in at least one aircraft mounted structure. The system comprises the following. At least two antenna discs are externally mounted on an aircraft fuselage. Each disc is either a transmit antenna or a receive antenna. The transmit antenna and the receive antenna each have a plurality of phased array antenna elements. Each antenna element of the transmit antenna and the receive antenna are joined to a surface of a pre-selected antenna disc to either transmit or receive an electromagnetic signal. The electromagnetic signal has a transmit frequency and a receive frequency. A power and control equipment group is coupled to each disc, which converts between an aircraft communication frequency and either the receive or transmit frequency. The disc is shaped to incorporate the antennas and the equipment group within an aerodynamic configuration.

In still another aspect of the invention, signal attenuation is reduced. Signals at or above S-band frequency (about 6 GHz) including the exemplary Connexion By Boeing$^{SM}$ signal frequency in the 12 to 14 GHz range, suffer attenuation of signal strength over relatively short, i.e., about 3 meters (3.25 feet) or less cable lengths. According to the invention, upon receipt of a signal above S-band frequency by a phased array receive antenna, a conversion is performed within the antenna structure down to an L-band frequency range which is within the aircraft communication frequency. For the exemplary Connexion By Boeing$^{SM}$ system, a 12 GHz receive channel signal is reduced to an L-band frequency of about one (1) GHz. The 1 GHz frequency is used when transferring communication signals within the aircraft. Converting to the L-band 1 GHz frequency results in signal attenuation which is about 10% of the attenuation at the higher 12 GHz frequency.

For signal transmission, the 1 GHz internal signal frequency is transferred to a transmit antenna where it is converted within the antenna to the 14 GHz RF transmit frequency. The converters required to convert each of the receive and transmit signals between the higher receive and transmit ranges and the lower L-band frequency range are incorporated within the antenna structure mounted external to the aircraft. In addition to reduced attenuation, this conversion unconstrains the exemplary RF frequency limitation of about 1.2 meters (four feet) for signal line length between the antenna(s) and converter(s) by increasing this distance up to about 62 meters (two hundred feet).

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
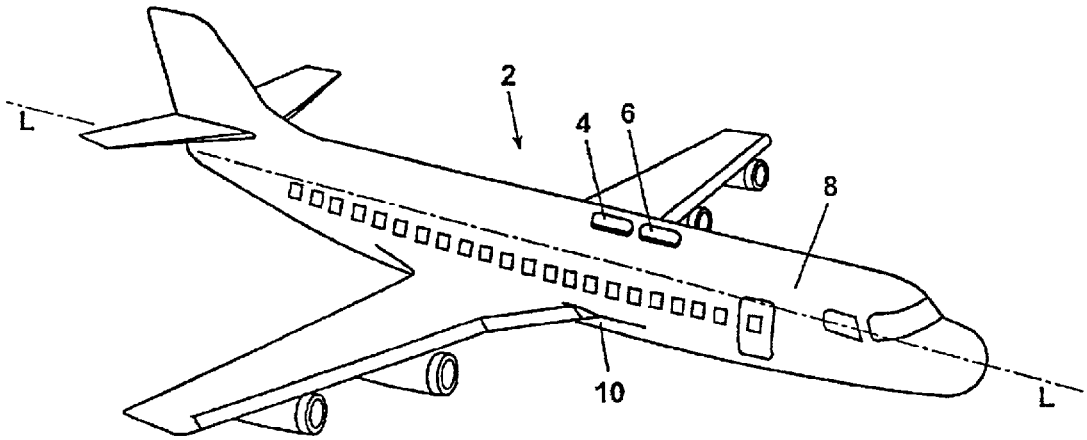
FIG. 1 is a perspective view of an exemplary aircraft having two phased array antenna structures of the present invention mounted on the fuselage.

FIG. 1 provides transmit and receive antennas for one aspect of the present invention. An exemplary aircraft 2 is shown having an exemplary arrangement of two antennas, a transmit antenna 4 and a receive antenna 6 mounted on the outer aircraft fuselage 8. In a preferred embodiment both the external configurations of the transmit antenna 4 and receive antenna 6 have a tear-drop shape to minimize aerodynamic drag on the aircraft. The preferred location for the transmit and receive antennas is in a fore-aft, linear arrangement having both antennas located in parallel with a longitudinal axis L of the aircraft on an upper surface of the fuselage 8 and proximate to the fore-aft location along the longitudinal axis L where the leading edge of the aircraft wings 10 intersect the aircraft 2. The one or more antennas of the present invention are mounted directly to the outer fuselage 8 of the aircraft.

Figure 2:
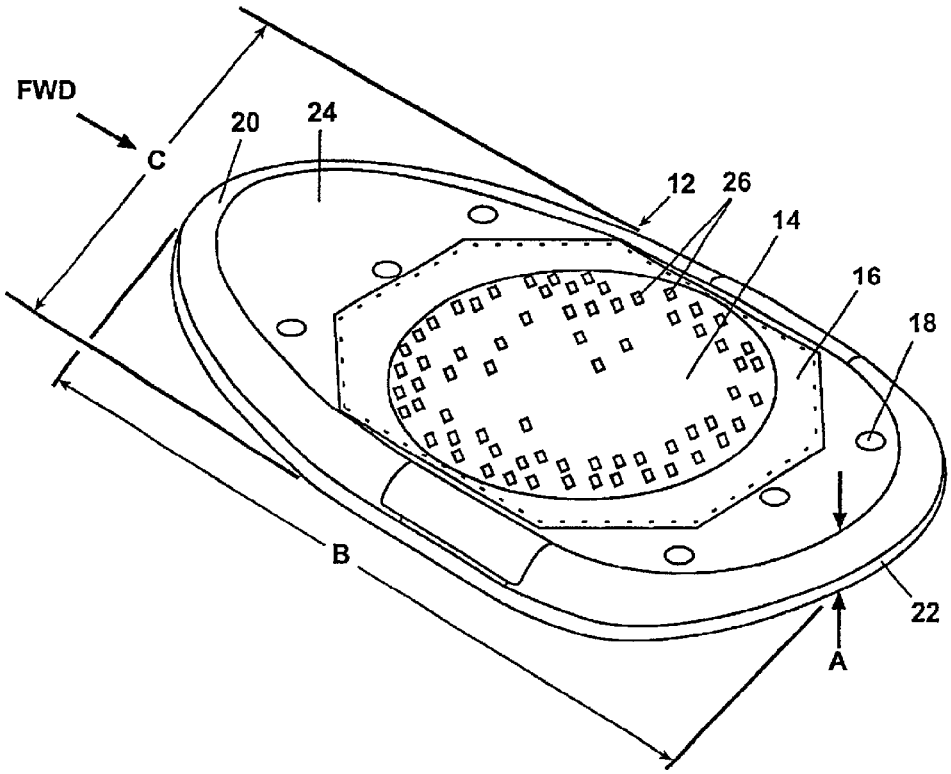
FIG. 2 is a perspective view of an exemplary tear-drop shaped phased array antenna of the present invention showing an antenna and support equipment space envelope.

Referring now to FIG. 2, a tear-drop shaped antenna configuration for mounting the array electronics and the electronics module for an antenna of the present invention is shown. FIG. 2 represents an exemplary tear-drop shaped antenna body 12 wherein either the transmit antenna 4 elements or receive antenna 6 elements may be configured within an exemplary circular array electronic space envelope 14 shown. An antenna body 12 having a generally tear-drop shape advantageously provides space for both the array electronics space envelope 14 and the electronics module space envelope 16. Electronics module space envelope 16 represents the mounting space envelope for associated antenna support equipment located in either antenna structure. Also provided on the antenna body 12 are access openings for the mounting bolts (not shown) which support the antenna body 12 to the fuselage 8 of the aircraft. Access areas 18 are shown for an exemplary 6 mounting bolt configuration.

Antenna body 12 further comprises an antenna trailing edge 20 and an antenna leading edge 22. Electronics module space envelope 16 is outlined on the antenna upper surface 24 of antenna body 12. The exemplary antenna body shown has an antenna depth A, an antenna length B and an antenna width C. In a preferred embodiment of the invention, the antenna depth A is about 5 centimeters (2 inches) at its minimum depth which occurs at about the center of antenna body 12. The antenna length B is up to about 1.8 meters (72 inches) and the antenna width C is about 1.1 meters (42 inches). Dimensions A, B, and C for the antenna body can also be varied depending upon the shape and size of the array desired for the phased array antenna elements 26 provided in the array electronics space envelope 14.

In the configuration of FIG. 2, exemplary electronics space envelope 14 is circular in shape, however the shape of the envelope can be varied to suit the configuration of the phased array elements 26. Only a portion of the phased array elements 26 are shown for information. The number of elements can easily exceed one thousand in a typical phased array antenna.

By providing a 5-volt DC converter (not shown) in close proximity to phased array elements 26 and within the electronics module space envelope 16 of the antenna, the size of the cabling (not shown) required to carry the large current between the 5-volt DC converter and the individual elements is reduced. The cable which is normally used for the purpose of carrying high current between the 5-volt DC converter and the phased array elements can be replaced with a solid bus bar for an antenna of the present invention.

The plurality of phased array elements 26 comprise multiple replications of phased array antennas which may be populated (i.e., configured) into a grid pattern depending upon the pre-determined shape. In addition to the circular shape shown, the phased array elements may be populated in rectangular, elliptical, or other geometric shapes. The antenna depth A shown in FIG. 2 is largely dependent on the space envelope required for the individual phased array elements. Support equipment for the antenna array(s) is advantageously located adjacent to the phased array elements without increasing antenna depth A.

Figure 3:
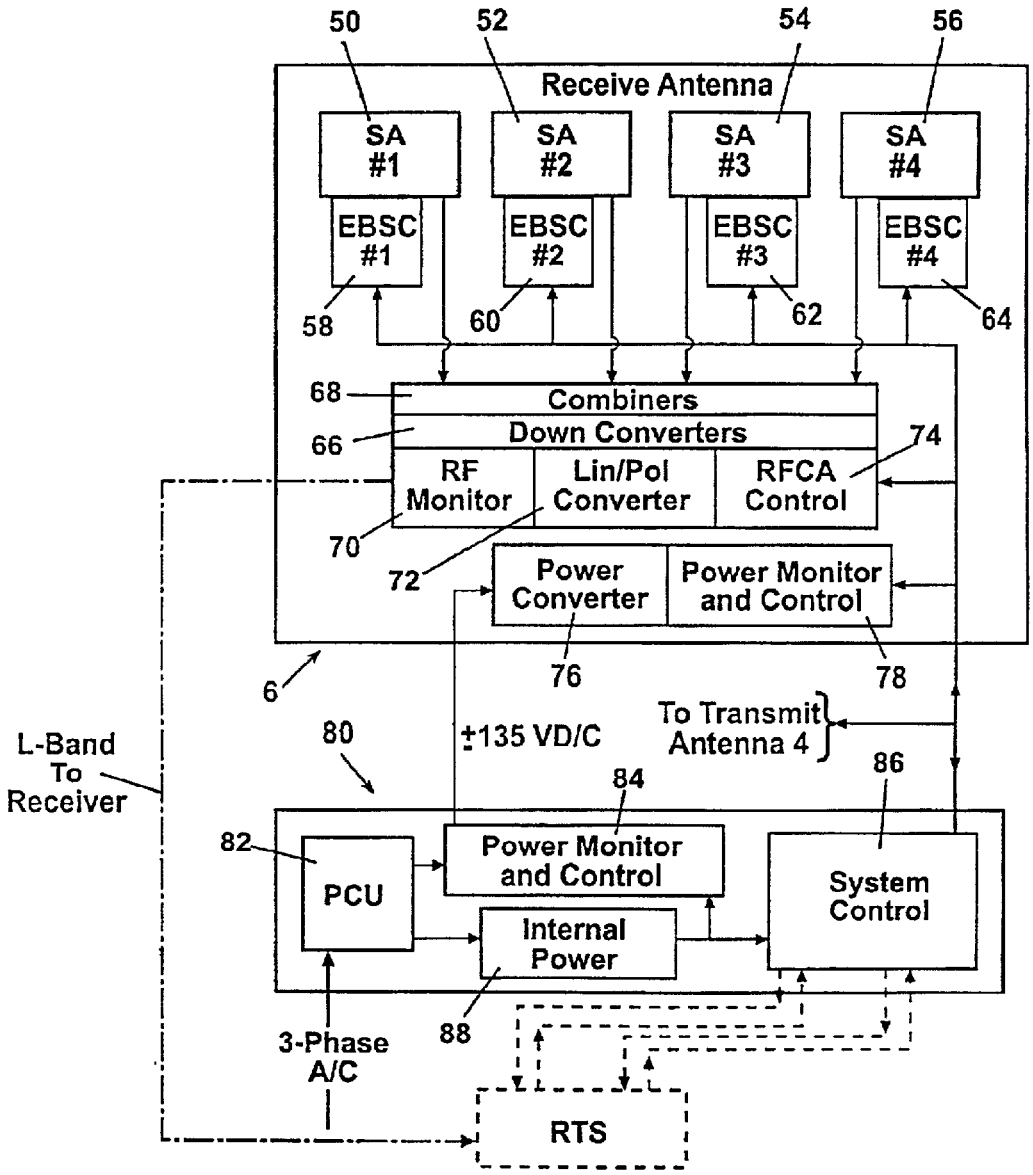
FIG. 3 is a block diagram of the present invention showing a receive antenna connected to the system power and control unit.
Figure 4:
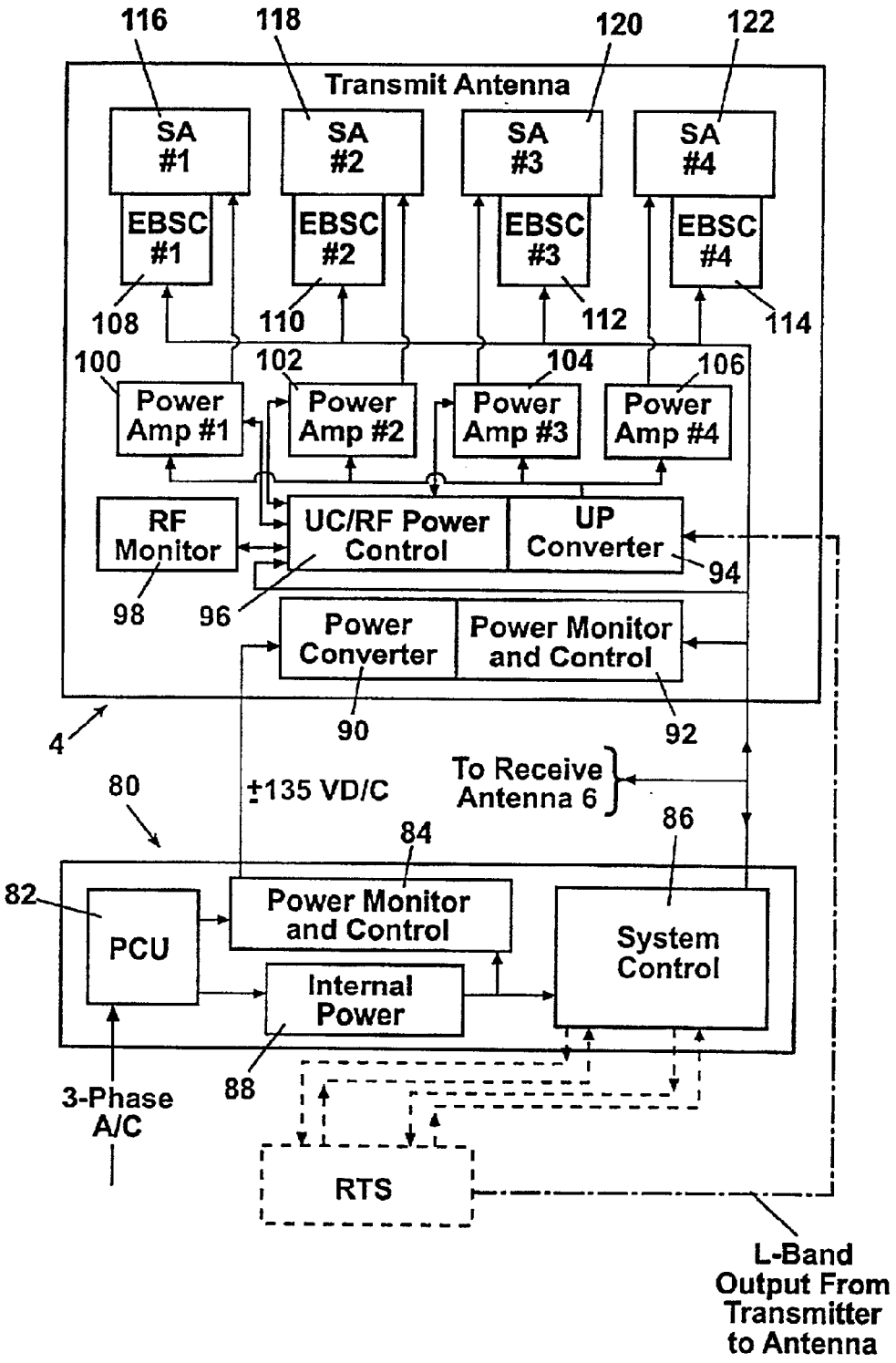
FIG. 4 is a block diagram of the present invention showing a transmit and a receive antenna connected to the system power and control unit.

Referring to both FIGS. 3 and 4, block diagrams of the components and connections of the present invention are shown. Each array comprising multiple phased array antenna elements is normally sub-divided into one or more sub-arrays. FIG. 3 provides an exemplary four sub-arrays; sub-arrays 50, 52, 54, and 56. Each sub-array is supported by an external beam steering controller. External beam steering controller (EBSC) 58 supports sub-array 50, EBSC 60 supports sub-array 52, EBSC 62 supports sub-array 54 and EBSC 64 supports sub array 56.

Also provided within the structure of receive antenna 6 is a down converter unit 66. The combined signals from each of the individual sub-arrays is transferred to down convert unit 66 after being combined by signal combiners 68. A radio frequency (RF) monitor 70, linear polarization (Lin/Pol) converter 72 and radio frequency converter assembly (RFCA) 74 are also provided. In an alternate embodiment, the linear polarization converter 72 could be placed ahead of down converters 66. The combined signals are converted from the about 12 GHz receive frequency to an L-band frequency range. In a preferred embodiment the signals are converted to a frequency of about 1 GHz. The 1 GHz signal frequency is then transmitted to internal aircraft communication systems equipment (not shown) via the receiver/transmitter system (in phantom). Multiple, concurrent L-band changes can be provided to account for polarization-diversity of satellites at a single orbital location. In the preferred embodiment, up to four concurrent channels are provided to the receivers, representing vertical, horizontal, left-hand circular, and right-hand circular polarizations. Receive antenna 6 also employs a power converter 76, and a power monitor and control unit 78. Power converter 76 converts the higher DC voltage from the aircraft system power control unit 80 to the lower 3 to 6-volt DC power required by the antenna array.

FIG. 3 identifies the DC power provided between system power and control unit 80 and power converter 76 delivered at 270 volts DC, then delivered differentially at +/−135 volts DC required to operate each of the receive antenna 6 and the transmit antenna 4. For the antennas of the present invention, DC power may range from the preferred high of about +/−135 volts to each antenna to a low of about 28 volts to each antenna. The higher voltage minimizes current and associated cable weight. The differential voltage of +/−135 volts DC referenced to aircraft structure reduces corona effects compared with 270 volts DC referenced to aircraft structure. The components within receive antenna 6 are supported by the antenna structure to the fuselage of the aircraft. The remaining items shown on FIG. 3 are supported within the aircraft, comprising system and power control unit 80 and its necessary components.

System power and control unit 80 comprises a power conversion unit 82, a power monitor unit 84, a system control unit 86, and an internal power source 88. Power conversion unit 82 receives the aircraft three-phase 115-volt AC, 400 Hz power source and converts this to the 28 to 270 volt DC power for powering the phased array antenna elements. The output of power conversion unit 82 supplies internal power unit 88 and power monitor and control unit 84. The direct current voltage which is provided to each antenna element array is provided through power monitor and control unit 84. The output of internal power unit 88 provides additional power to power monitor and control unit 84 as well as power to system control unit 86. System control unit 86 provides steering commands to manage the configuration of the arrays of the two antennas 4 and 6 respectively. System control unit 86 is shown interfacing with a receiver/transmitter (shown in phantom). The receiver/transmitter is an internal aircraft mounted component which is used to convert digital signals into the L-band frequency for internal aircraft use. The receiver/transmitter is shown in phantom for information purposes only.

Referring now to FIG. 4, a transmit antenna of the present invention is shown. Similar to the arrangement of FIG. 3, FIG. 4 identifies the system power and control unit. This unit is the same unit identified in FIG. 3 and therefore no further description of its components will be provided herein. Transmit antenna 4 is comprised of a group of components which will be further described herein. Power converter 90 is similar to power converter 76 of FIG. 3 in that power converter 90 is used to convert the +/−35-volt DC power to the antenna 3 to 6-volt DC power. Power monitor and control unit 92 is similar to power monitor and control unit 78 shown in FIG. 3. Output from the power converter 90 and power monitor and control unit 92 is provided to the sub-arrays of antennas similar to FIG. 3. An Up-converter 94 and an Up-converter RF power control unit 96 are also shown. These units receive a signal from system control unit 86 and convert the L-band, 1 GHz signal from the aircraft communication systems via the receive/transmit system (in phantom), up to the 14 GHz transmit frequency required for the exemplary Connexion By Boeing$^{SM}$ System. The output of Up-converter 94 supplies the input to power amplifier 100, power amplifier 102, power amplifier 104, and power amplifier 106 respectively. In an alternate embodiment, a single power amplifier supplies all four sub-arrays, depending on specific RF power requirements.

FIG. 4, similar to FIG. 3 provides an antenna arrangement having four sub-arrays of phased array antennas. The phased array antennas are shown as individual sub-arrays 116, 118,120, and 122 respectively. Each of the sub-arrays of antennas are consequently controlled by external beam steering controllers (EBSCs) 108, 110, 112, and 114 respectively. Power amplifiers 100, 102, 104, and 106 boost the signal strength prior to transmission through the phased array antenna elements. The output of each individual power amplifier provides a respective sub-array of phased array antenna elements. A radio frequency monitor 98 is also connected to the Up-converter, RF power control unit, providing a measurement of transmitted power.

The present invention provides several advantages. By advantageously using the volume of externally mounted antenna structures, support equipment for the phased array antennas is positioned within the antenna structure. This permits the internal arrangement of the aircraft to be unconstrained by the storage requirements for these pieces of equipment. By converting from the aircraft generated 3-phase AC power to an intermediate or transfer power, the size and weight of cabling between the aircraft mounted converters and the antenna mounted converters reduces weight and unconstrains the arrangement within the aircraft for this cabling. By locally converting an antenna transfer power within each antenna structure to the 3 to 6 volt DC voltage required to operate the elements of the phased array antennas, the size and amount of cabling required between these converters and the individual sub-arrays of elements can be controlled and weight therefore reduced. By converting to a lower internal aircraft communication frequency than the frequencies transmitted and received by the antennas, and locating the frequency converters within the antenna structures, signal attenuation loss is reduced.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A phased array antenna system for a mobile platform comprising:

a transmit antenna disposed within a first antenna housing;

a receive antenna disposed within a second antenna housing, said second antenna housing independently mountable from the first antenna housing;

said receive antenna operating to receive a receive antenna signal and to convert said receive antenna signal to an aircraft communication frequency signal before outputting said receive antenna signal from said second antenna housing; and said transmit antenna operating to transmit a transmit antenna signal and to convert said aircraft communication frequency signal into said transmit antenna signal within said first antenna housing;

wherein each of said first and second antenna housings are adapted for externally mounting to the mobile platform, said first and second antenna housings being mounted in a front-to-back linear arrangement with respect to each other.

2. The antenna system of claim 1 further comprising:

a converter disposed within each of said first and second antenna housings;

an aircraft transfer power in communication with said converter; and said converter converts said aircraft transfer power to a phased array antenna power.

3. The antenna system of claim 1 further comprising:

a first frequency converter disposed within said second antenna housing for converting said receive antenna signal to said aircraft communication frequency signal; and a second frequency converter disposed within said first antenna housing for converting said aircraft communication frequency signal to said transmit antenna signal.

4. The antenna system of claim 3 further comprising;

said receive antenna signal comprising a first signal, said first signal being in a frequency range of about 12 gigahertz to about 20 GHz;

said aircraft communication frequency signal comprising a second signal having a frequency of about 1 gigahertz; and said transmit antenna signal comprising a third signal, said third signal being in a frequency range of about 14 gigahertz to about 44 GHz.

5. The antenna system of claim 1, wherein each of said first and second antenna housings further include a substantially tear-drop shape.

6. A phased array antenna communication system for external mounting on a mobile platform comprising:

a pair of antennas being one each of a transmit antenna and a receive antenna;

a transmit antenna housing for enclosing the transmit antenna and a transmit antenna equipment group;

a receive antenna housing independently positionable from the transmit antenna housing for enclosing the receive antenna and a receive antenna equipment group;

each equipment group being in electrical communication with an aircraft communication signal, said signal having an operating frequency ranging from an ultra-high frequency to an L-band frequency;

an aircraft mounted converter to convert an aircraft service voltage to an antenna power transfer voltage; and each antenna housing having a transfer converter to convert said transfer voltage to an antenna operating voltage and each adaptable for external mounting to the mobile platform;

wherein a depth of said transmit and receive antenna housings is determinable by a space envelope of the transmit and receive antennas, said transmit antenna equipment group and said receive antenna equipment group being each positionable adjacent the space envelope of respective ones of the transmit and receive antennas within their respective housings without increasing said depth.

7. The communication system of claim 6 further comprising:

said transmit antenna housing having an upper surface and a first set of phased array antenna elements arranged in a grid formation on the transmit antenna upper surface; and said receive antenna housing having an upper surface and a second set of phased array antenna elements arranged in the grid formation on the receive antenna upper surface.

8. The communication system of claim 7 further comprising:

each antenna housing having an internal volume;

each set of phased array antenna elements occupies a first portion of each housing internal volume; and a preselected one of the transmit antenna equipment group and the receive antenna equipment group occupies a second portion of each housing internal volume.

9. The communication system of claim 6 further comprising:

each antenna being in electrical communication with an aircraft internally mounted receiver;

said aircraft communication signal has a frequency of about one gigahertz (GHz), said frequency preselected to reduce a signal attenuation; and said signal attenuation allows for a distance range between each antenna and the aircraft receiver.

10. The communication system of claim 9 further comprising:

said distance range between each antenna and the aircraft mounted receiver being between about 1.2 meters and about 62 meters.

11. The communication system of claim 6 further comprising:

said transfer voltage comprising about a 270 volt direct current (DC);

said about 270 volt DC transfer voltage forming a differential pair of about ±135 volt DC voltages;

a first of said pair of about ±135 volt DC voltages being in communication with the transmit antenna; and a second of said pair of about ±135 volt DC voltages being in communication with the receive antenna.

12. The communication system of claim 6 wherein said receive antenna receives a data communication signal in a frequency range lying between about 12 gigahertz (GHz) and about 20 GHz.

13. The communication system of claim 12 wherein said transmit antenna transmits the data communication signal in a frequency range lying between about 14 GHz and about 44 GHz.

14. The communication system of claim 6 further comprising:

said system equipment groups each include at least internal power equipment for the antenna, position control equipment for the antenna, at least one power converter for the antenna, a radio frequency monitor, and at least one of an Up-converter and a Down-converter.

15. The communication system of claim 6 further comprising:

said transfer converter converts the transfer voltage within each housing to an antenna operating voltage of about 5 volts direct current to operate each antenna.

16. An aircraft phased array antenna communication system providing antennas and antenna servicing equipment in at least one aircraft mounted structure, said system comprising:

at least two antenna discs externally mounted on an aircraft fuselage adjacent and in a fore-aft orientation with respect to each other, each disc forming one of a transmit antenna housing and a receive antenna housing;

the transmit antenna housing and the receive antenna housing each having a plurality of phased array antenna elements disposed therein;

each of the plurality of phased array antenna elements being connectably joined to a surface of a pre-selected antenna disc for one of transmitting and receiving an electromagnetic signal;

said electromagnetic signal being one of a transmit frequency and a receive frequency;

a power and control equipment group positioned within each said disc; and each said equipment group operable to convert between one of the transmit frequency and the receive frequency and an aircraft communication signal frequency.

17. The communication system of claim 16 wherein said equipment group comprises at least a converter to convert an aircraft voltage to an antenna operating voltage being about 5 volts direct current.

18. The communication system of claim 16 further comprising:

said electromagnetic signal transmit frequency selected from a frequency range between about 14 gigahertz (GHz) and about 44 GHz; and said electromagnetic signal receive frequency selected from a frequency range between about 12 GHz and about 20 GHz.

19. The communication system of claim 18 further comprising:

an Up-converter to convert said aircraft communication signal frequency to the transmit frequency; and a Down-converter to convert said receive frequency to the aircraft communication signal frequency.

20. The communication system of claim 19 wherein said aircraft communication signal frequency is selected from a frequency range between an ultra-high frequency and an L-band frequency.

21. The communication system of claim 20 wherein said aircraft communication signal frequency comprises a frequency about one GHz.

22. The communication system of claim 19 wherein said up-converter is disposed within the transmit antenna housing.

23. The communication system of claim 19 wherein said Down-converter is disposed within the receive antenna housing.

24. The communication system of claim 23 wherein the transmit antenna housing and the receive antenna housing form a fore-aft antenna housing arrangement.

25. The communication system of claim 16 further comprising:

the transmit antenna housing and the receive antenna housing together forming an antenna housing pair;

said antenna housing pair disposed on an upper surface location of the aircraft fuselage; and said upper surface location circumferentially proximate to a wing leading edge intersection with the aircraft fuselage.

26. A phased array antenna communication system for external mounting on a mobile platform comprising:

a pair of multiple element phased array antennas including a transmit antenna and a receive antenna;

a transmit antenna housing for enclosing the transmit antenna and a transmit antenna equipment group;

a receive antenna housing for enclosing the receive antenna and a receive antenna equipment group;

wherein each of said transmit and receive antenna housings further include a substantially tear-drop shape adaptable to be entirely external to the mobile platform; and wherein a depth of said transmit and receive antenna housings is determinable by a space envelope of the transmit and receive antennas, said transmit antenna equipment group and said receive antenna equipment group being each positionable adjacent the space envelope of respective ones of the transmit and receive antennas without increasing said depth.

* * * * *